US010760359B2

(12) United States Patent
Clasen et al.

(10) Patent No.: US 10,760,359 B2
(45) Date of Patent: Sep. 1, 2020

(54) WELLBORE TONG

(71) Applicant: Weatherford Technology Holdings, LLC, Houston, TX (US)

(72) Inventors: Ditmar Clasen, Hannover (DE); Martin Helms, Burgdorf (DE); Bjoern Thiemann, Burgwedel (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 180 days.

(21) Appl. No.: 16/032,310

(22) Filed: Jul. 11, 2018

(65) Prior Publication Data

US 2020/0018129 A1 Jan. 16, 2020

(51) Int. Cl.
*E21B 19/16* (2006.01)
*E21B 19/10* (2006.01)

(52) U.S. Cl.
CPC ..... *E21B 19/165* (2013.01); *E21B 19/10* (2013.01); *E21B 19/164* (2013.01)

(58) Field of Classification Search
CPC ..... E21B 19/164; E21B 19/165; E21B 19/10
See application file for complete search history.

(56) References Cited

U.S. PATENT DOCUMENTS 3,875,826 A 4/1975 Dreyfuss et al.
4,089,240 A 5/1978 Eckel
5,501,107 A 3/1996 Snyder et al.
5,904,075 A 5/1999 Buck
6,050,156 A 4/2000 Buck
7,090,254 B1 8/2006 Pietras et al.
7,114,235 B2 10/2006 Jansch et al.
7,128,300 B2 * 10/2006 Frick ..... F16M 11/2014 248/418
7,762,160 B2 * 7/2010 Basler ..... E21B 19/164 81/57.18
8,336,614 B2 * 12/2012 Bagassi ..... E21B 19/155 166/75.11
8,465,203 B2 * 6/2013 Barker ..... A61B 6/4405 378/197
8,733,213 B2 * 5/2014 Taggart ..... E21B 19/161 81/57.11

(Continued)

OTHER PUBLICATIONS

EPO Extended European Search Report dated Jan. 28, 2020, for European Application No. 19174001.8.

(Continued)

*Primary Examiner* — David B. Thomas
(74) *Attorney, Agent, or Firm* — Patterson + Sheridan, LLP

(57) ABSTRACT

A tong includes a gear ring powered by a motor assembly, the gear ring having a plurality of ramps formed on an inner surface thereof and a brake plate rotationally independent of the gear ring, the brake plate having a gripping assembly for interacting with the ramps to grip a tubular. Also included is a brake assembly for preventing rotation of the brake plate, the brake assembly including an adjustable brake band for applying friction to the brake plate and at least one brake pad made of braking material disposed on an outer surface thereof in the area of contact with the brake band for reducing friction between the brake plate and the brake band. In one embodiment, the braking material is bronze.

14 Claims, 12 Drawing Sheets

(56) References Cited

U.S. PATENT DOCUMENTS

| | | | | |
|---|---|---|---|---|
| 9,010,219 | B2 * | 4/2015 | Feigel, Jr. | E21B 19/164 81/57.15 |
| 10,100,593 | B2 | 10/2018 | Musemeche | |
| 10,233,704 | B2 * | 3/2019 | Bouligny | E21B 19/165 |
| 10,472,905 | B2 * | 11/2019 | Smith | E21B 19/161 |
| 2002/0088674 | A1 | 7/2002 | Wassenhoven | |
| 2005/0188793 | A1 | 9/2005 | Cherry | |
| 2005/0241442 | A1 | 11/2005 | Neves | |
| 2009/0272233 | A1 * | 11/2009 | Musemeche | E21B 19/164 81/57.16 |

OTHER PUBLICATIONS

Australian Examination Report dated Feb. 19, 2020, for Australian Patent Application No. 2019202776.

* cited by examiner

WELLBORE TONG

BACKGROUND

Field

Embodiments described herein generally relate to a tong for use at a wellbore.

Description of the Related Art

Wellbore tongs are well known in the art for making and breaking threaded connections between tubulars as strings are assembled or disassembled for use in a wellbore. Typically, a back-up or lower tong holds a tubular extending from the wellbore while an upper tong grasps and then rotates a new tubular into our out of the string. In most cases, the upper tong includes a mechanism to grasp the tubular and then, in a separate step, rotates the tubular to perform threading or unthreading. During the grasping step, one rotating portion of the assembly must be held in place while the gripping assembly operates. Thereafter, both portions are rotated as a unit during the threading operation. There is a need for an improved braking assembly to temporarily hold the rotating portion during the gripping step.

SUMMARY

The present disclosure generally concerns a wellbore tong. In one embodiment, the tong includes a gear ring powered by a motor assembly, the gear ring having a plurality of ramps formed on an inner surface thereof and a brake plate rotationally independent of the gear ring, the brake plate having a gripping assembly for interacting with the ramps to grip a tubular. In a first position of the gear ring relative to the brake plate, the gripping assembly is open and in a second position the assembly grips the tubular. Also included is a brake assembly for preventing rotation of the brake plate, the brake assembly including an adjustable brake band for applying friction to the brake plate and at least one brake pad made of braking material disposed on an outer surface thereof in the area of contact with the brake band for reducing friction between the brake plate and the brake band. In one embodiment, the braking material is bronze.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
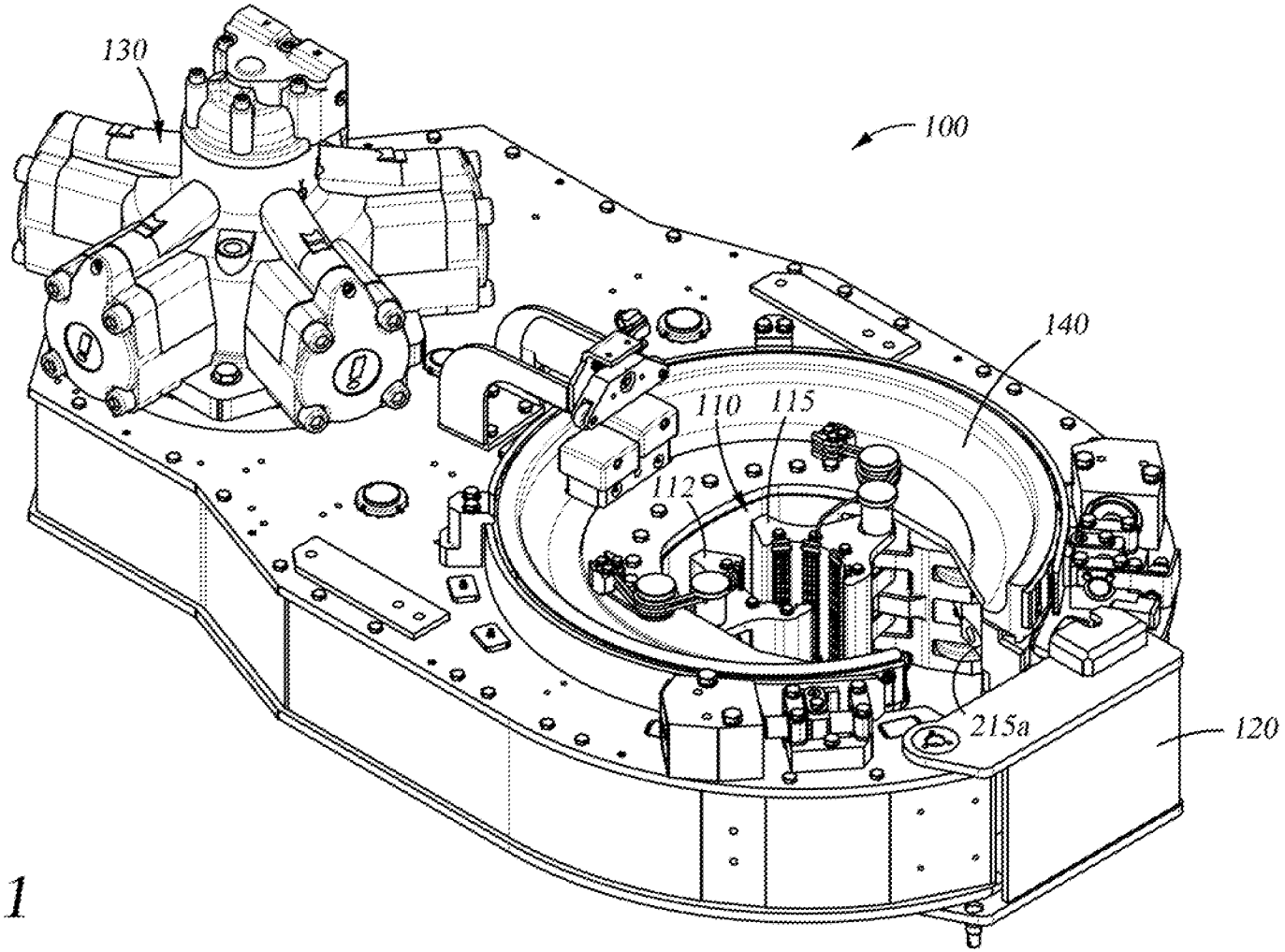
FIG. 1 is a perspective view of a wellbore tong.

FIG. 1 is a perspective view of a wellbore tong. The tong has two functions: it grasps a tubular (not shown) using a gripping assembly generally shown as 110 and thereafter, it rotates the tubular relative to a tubular therebelow in order to make or break a threaded connection therebetween. A door 120, shown in a closed position, permits the tubular to be inserted into the gripping assembly 110 of the tong 100. A hydraulic motor assembly generally shown as 130 rotates a gear ring (not visible) that is responsible for rotation of the tubular when a connection is made. Separately, a "cage" or brake plate 140 is rotatable independent of the gear ring. In the embodiment shown, the gripping assembly 110 is associated with the rotatable brake plate 140 and rotates therewith. Separately, inwardly facing ramps (not visible) are formed on an inner surface of the gear ring. To grip a tubular with the tong 100, it is necessary to rotationally fix the brake plate 140 with its gripping assembly 110 while rotating the gear ring in order to urge the ramps of the gear ring under a plurality of wheels associated with the gripping assembly 110. The action of the wheels and ramps acts to close gripping members 112, 115 around the tubular. With the tubular gripped, both the gear ring and the brake plate 140 rotate together to make (or break) a connection.

Figure 2:
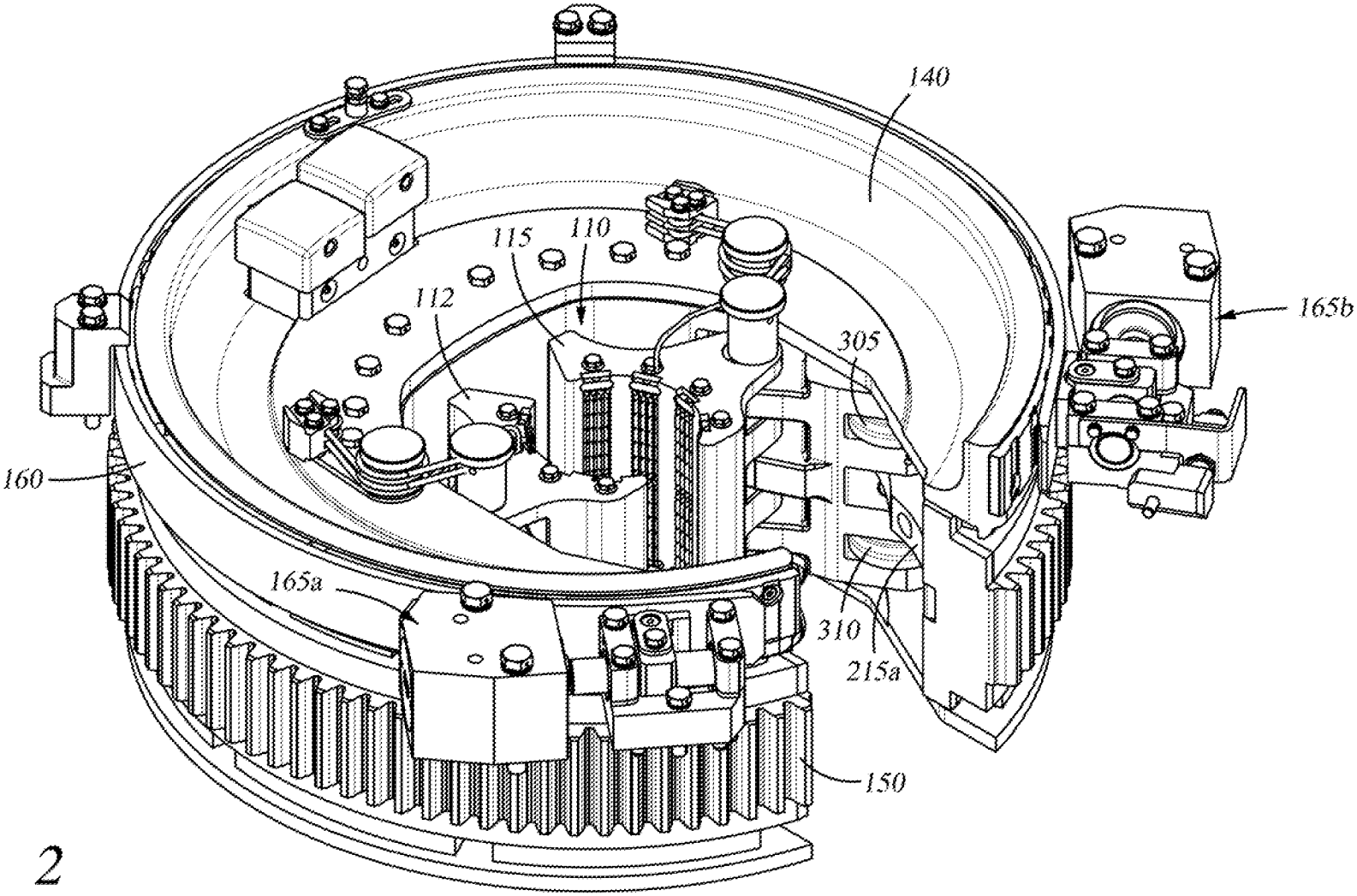
FIG. 2 is a perspective view of a portion of the tong including a rotatable brake plate, a gripping assembly rotatable therewith and a separately rotatable gear ring.

FIG. 2 is a perspective view of a portion of the tong 100 including the rotatable brake plate 140, the gripping assembly 110 rotatable therewith and a separately rotatable gear ring 150. The gear ring includes teeth formed on a perimeter thereof for engagement with corresponding teeth associated with the motor assembly 130 (FIG. 1). Also shown in FIG. 2 is a braking assembly for the brake plate in order to stop its rotation during the gripping portion of the operation. The breaking assembly, as will be described in additional detail herein, includes a brake band 160 that can be tightened thereby providing friction between the band 160 and the brake plate 140. The tightening takes place at each end of the band with piston-actuated braking members 165*a*, 165*b*.

Figure 3:
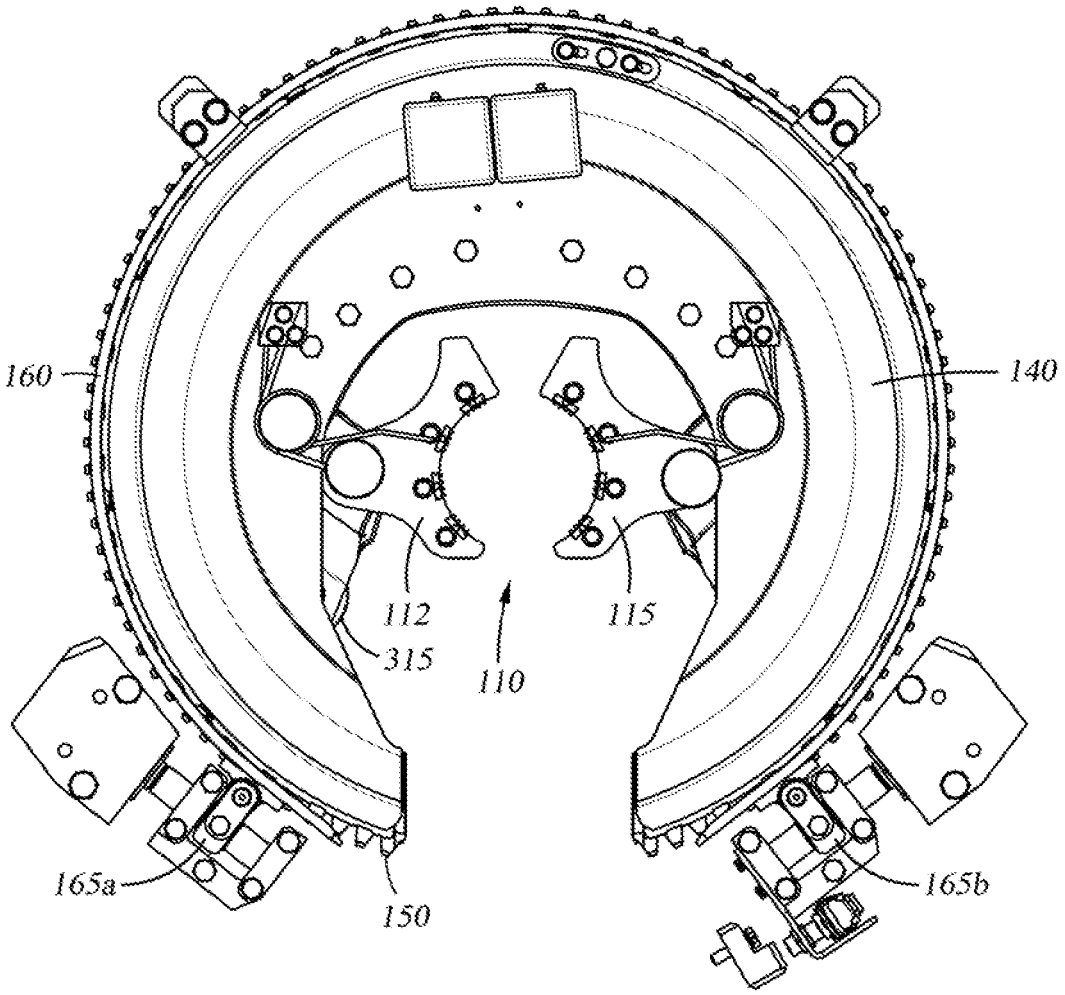
FIG. 3 is a top view of the assembly of FIG. 2 showing gripping members that are a part of the gripping assembly.

FIG. 3 is a top view of the assembly of FIG. 2 showing gripping members 112, 115 that are a part of the gripping assembly 110. As illustrated, the gripping members can be actuated towards or away from the centerline of a tubular.

Figure 4:
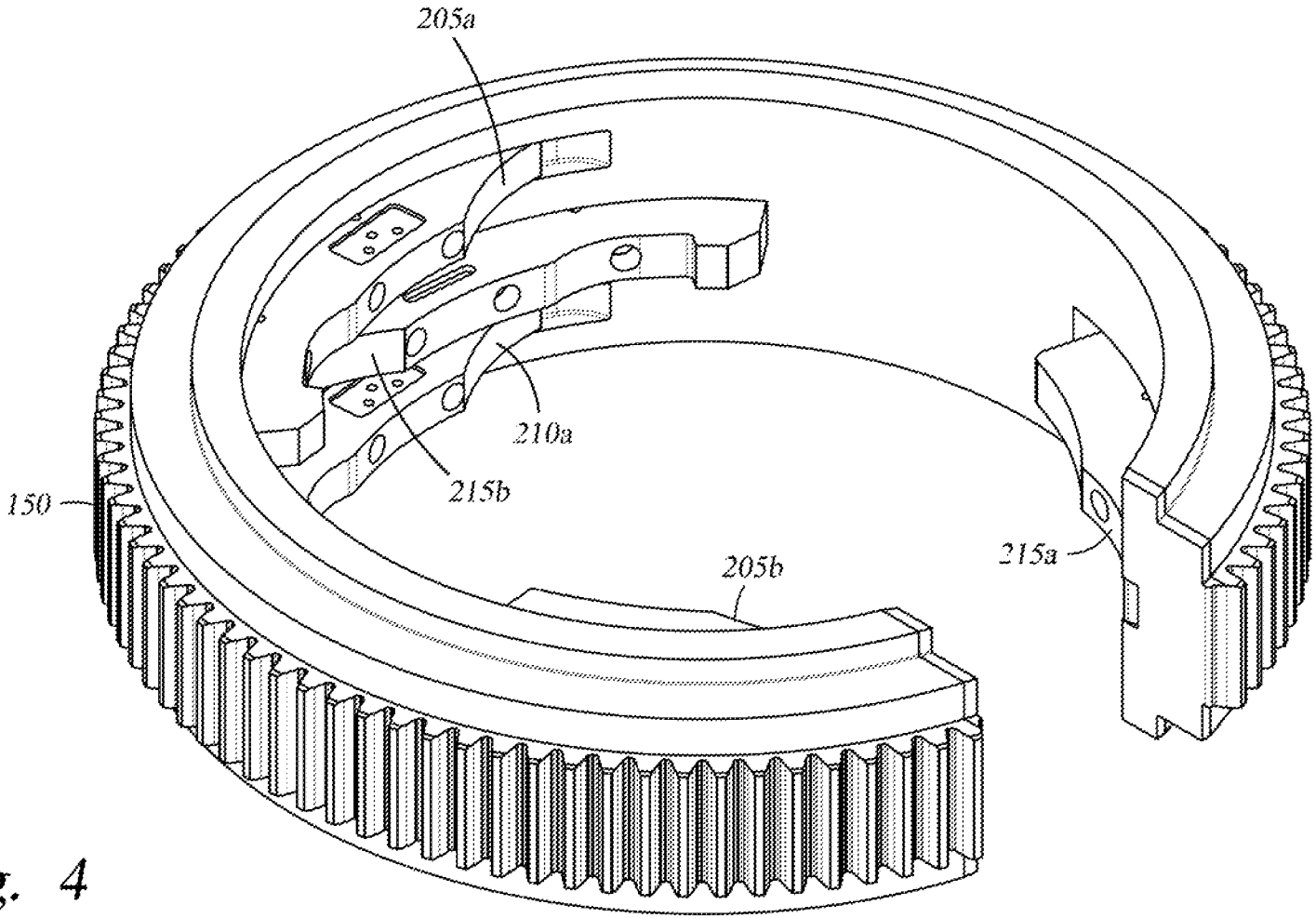
FIG. 4 is a perspective view of the gear ring showing a plurality of ramps formed on an inner surface thereof.

FIG. 4 is a perspective view of the gear ring 150 showing a plurality of ramps 205*a*, 210*a*, 215*b* formed on an inner surface thereof opposite an opening or throat of the ring. The upper and lower ramps 205*a*, 210*a* are constructed and arranged to operate with a set of double wheels 305, 310

(FIG. 5) in order to actuate one gripping member 115 of the gripping assembly 110 when a threaded connection is being made. The center ramp 215*b*, as is evident by its direction is constructed and arranged to actuate a single wheel 315 associated with gripping member 112 when a connection between tubulars is being broken. An opposite group of ramps, two of which 215*a*, 205*b* are visible in FIG. 4 are responsible for a reverse arrangement wherein a second set of double ramps (upper ramp 205*b* is visible) operates with the double wheels 305, 310 to break a connection and a second single ramp 215*a* operates with the single wheel 315 when a connection is made.

Figure 5:
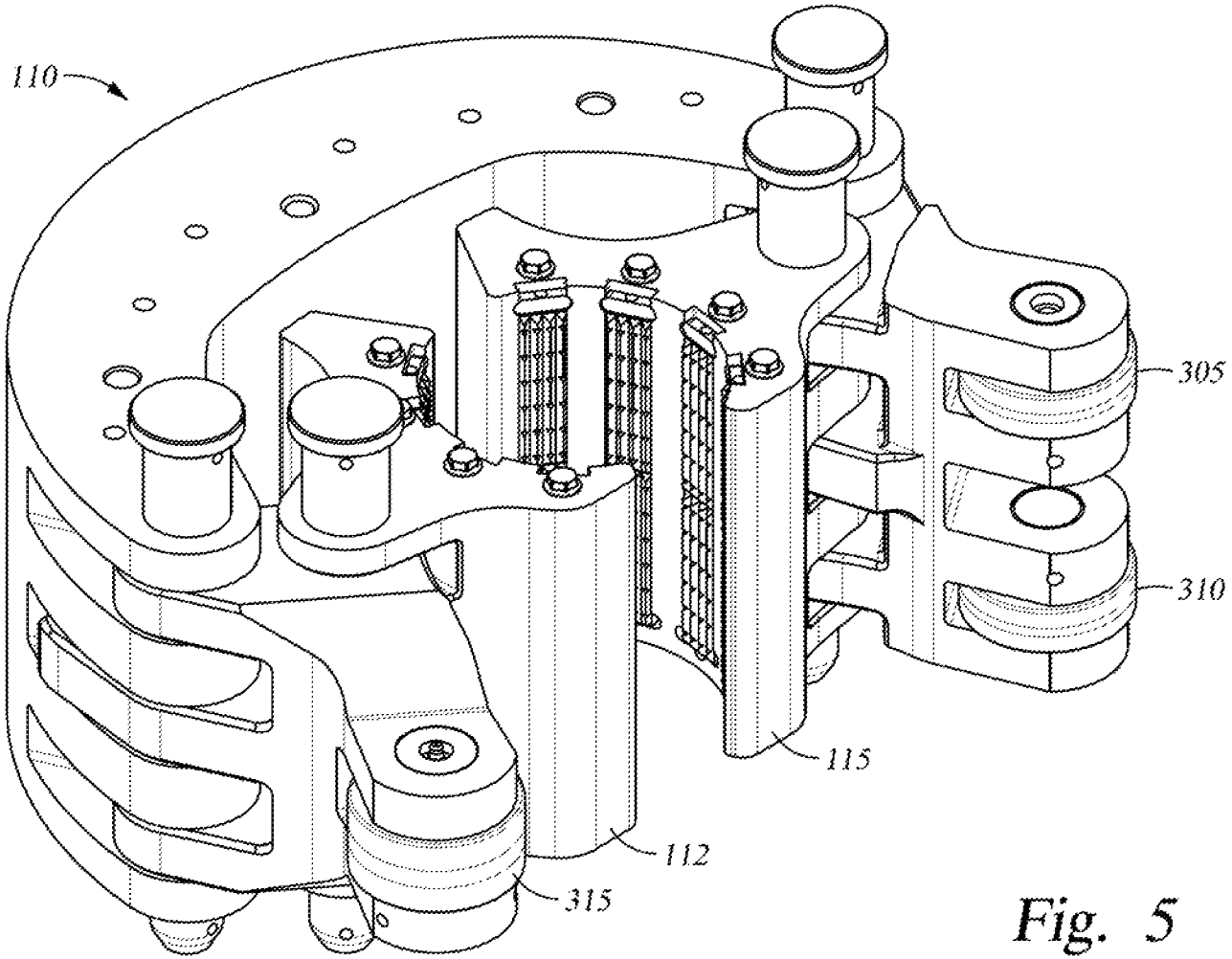
FIG. 5 is a perspective view of the gripping assembly illustrating a double pair of wheels on a first side and a single wheel on a second side.

FIG. 5 is a perspective view of the gripping assembly 110 illustrating the double pair of wheels 305, 310 on a first side and the single wheel 315 on a second side. The gripping assembly 110 is made up of two gripping members 112, 115, each operating like a slip with an inner surface having a concave shape to match the outer surface of the tubular to be grasped by the tong 100. As illustrated, the gripping assembly 110 utilizes the single wheel 315 associated with one gripping member 112 and the two-wheel set 305, 310 operating with a second gripping member 115. In operation, the wheels (along with the brake plate 140) remain rotationally fixed while the gear ring 150 with its various ramps rotates to a position wherein each wheel has ridden up a ramp. The result is a clamping action forcing the gripping members 112, 115 into contact with the tubular to be grasped. The make or break nature of the operation determines which set of ramps is utilized by the wheels as the tubular is gripped.

Figure 6:
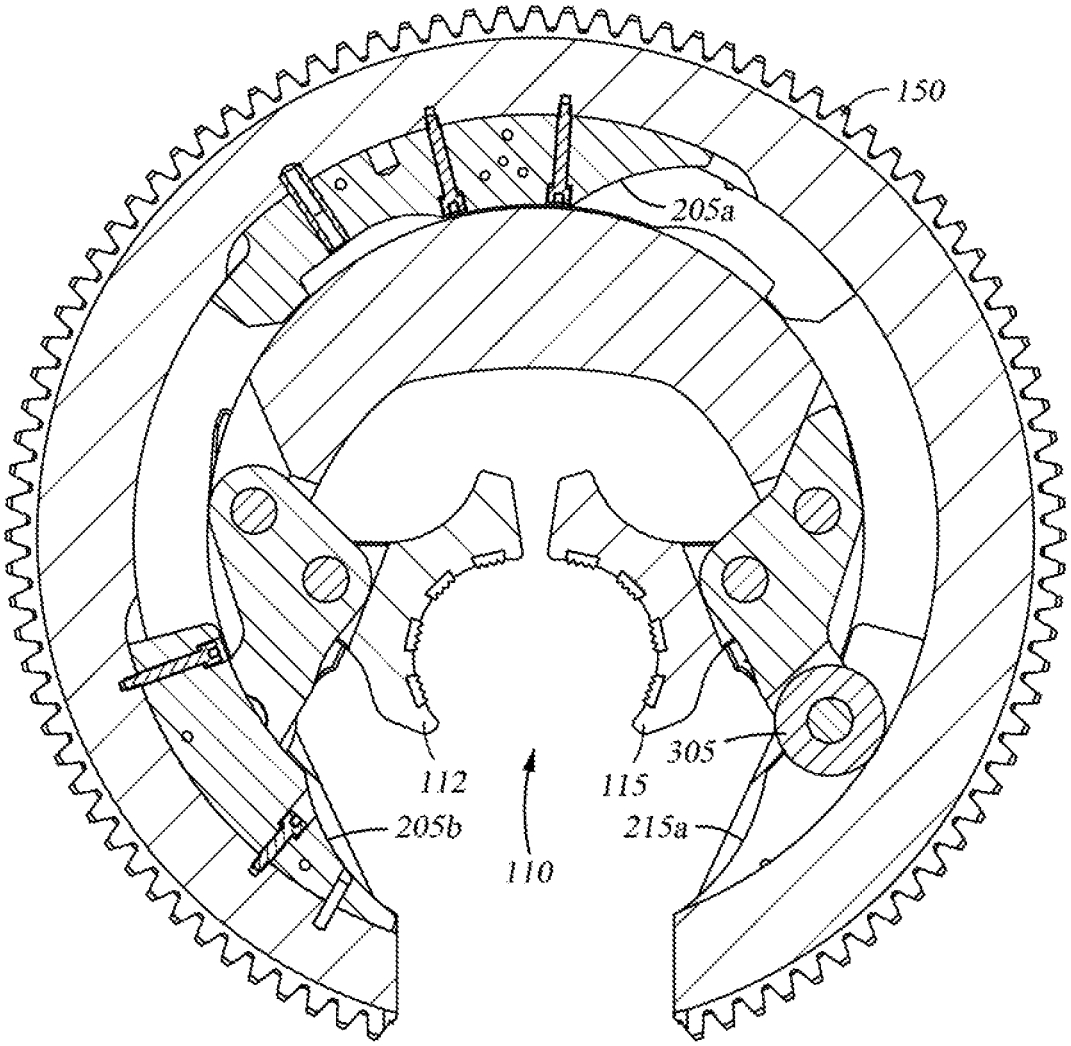
FIG. 6 is a top view partially in section, taken through one wheel of the double pair of wheels.
Figure 7:
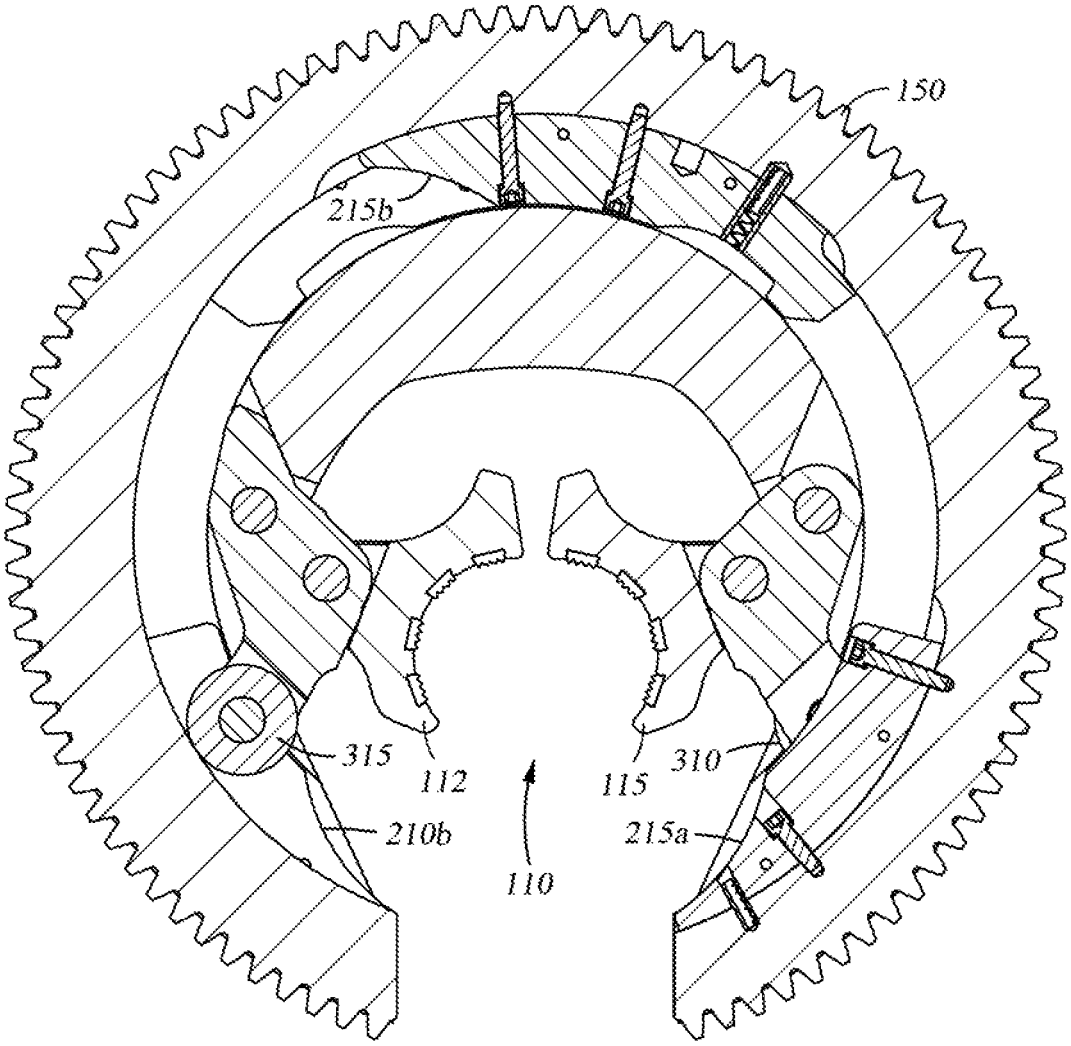
FIG. 7 is a top view partially in section, taken through the single wheel.

FIG. 6 is a top view partially in section, taken through one wheel 305 of the double pair of wheels 305, 310 and FIG. 7 is a top view partially in section, taken through the single wheel 315. In both Figures, the gripping mechanism is de-activated, meaning that the wheels and ramps are not in contact with one another as indicated by the open position of the gripping members 112, 155 in each Figure. For example, in FIG. 6, upper wheel 305 of the pair of wheels 305, 310 is visible above the ramp 215*a* that is designed to operate in conjunction with single wheel 315 when a connection is being broken. Similarly in FIG. 7, on the left side of the Figure, the single wheel 315 is visible with the lower ramp 210*b* below it.

Figure 8:
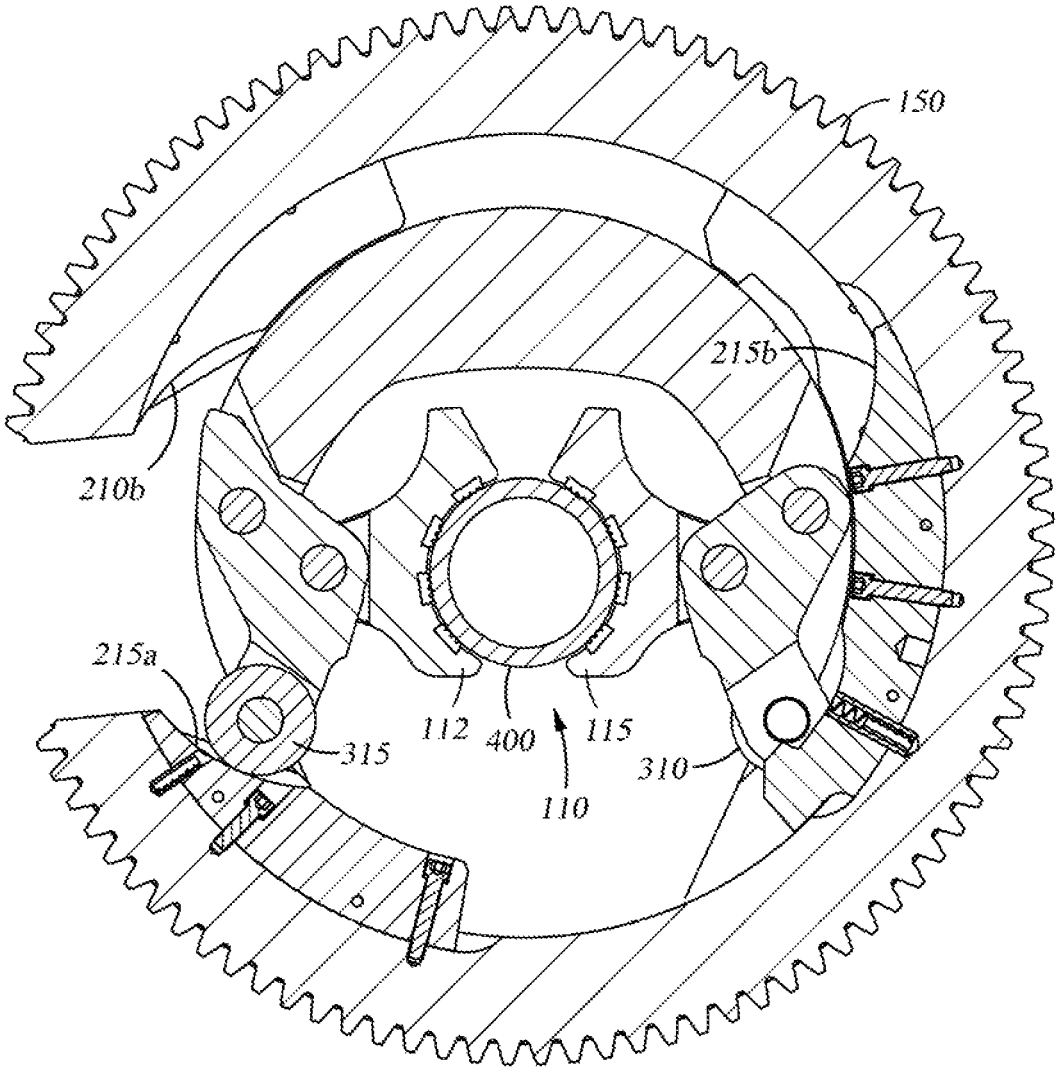
FIG. 8 is a top view partially in section, taken through the single wheel and showing the gripping assembly actuated around a tubular.

FIG. 8 is a top view partially in section, taken through the single wheel 315 and showing the gripping assembly 110 actuated around a tubular 400. More specifically, FIG. 8 is a top section view of the assembly shown in FIGS. 7 and 8 with the view taken through the single wheel 315. However, in FIG. 8 the gear ring 150 with its sets of ramps has been rotated clockwise while the brake plate 140 and gripping assembly 110 have been rotationally held in the same orientation as they are in FIGS. 7 and 8. The result is that the ramps have changed location relative to the wheels 305, 310, 315 in a manner whereby the wheels have mounted the ramps 215*a*, 205*a*, 210*a* that are designed to be utilized in actuating the gripping mechanism in order to make a connection. Because the wheels have been actuated by the ramps, the gripping mechanism 110 is actuated and the tubular 400 is gripped.

Figure 9:
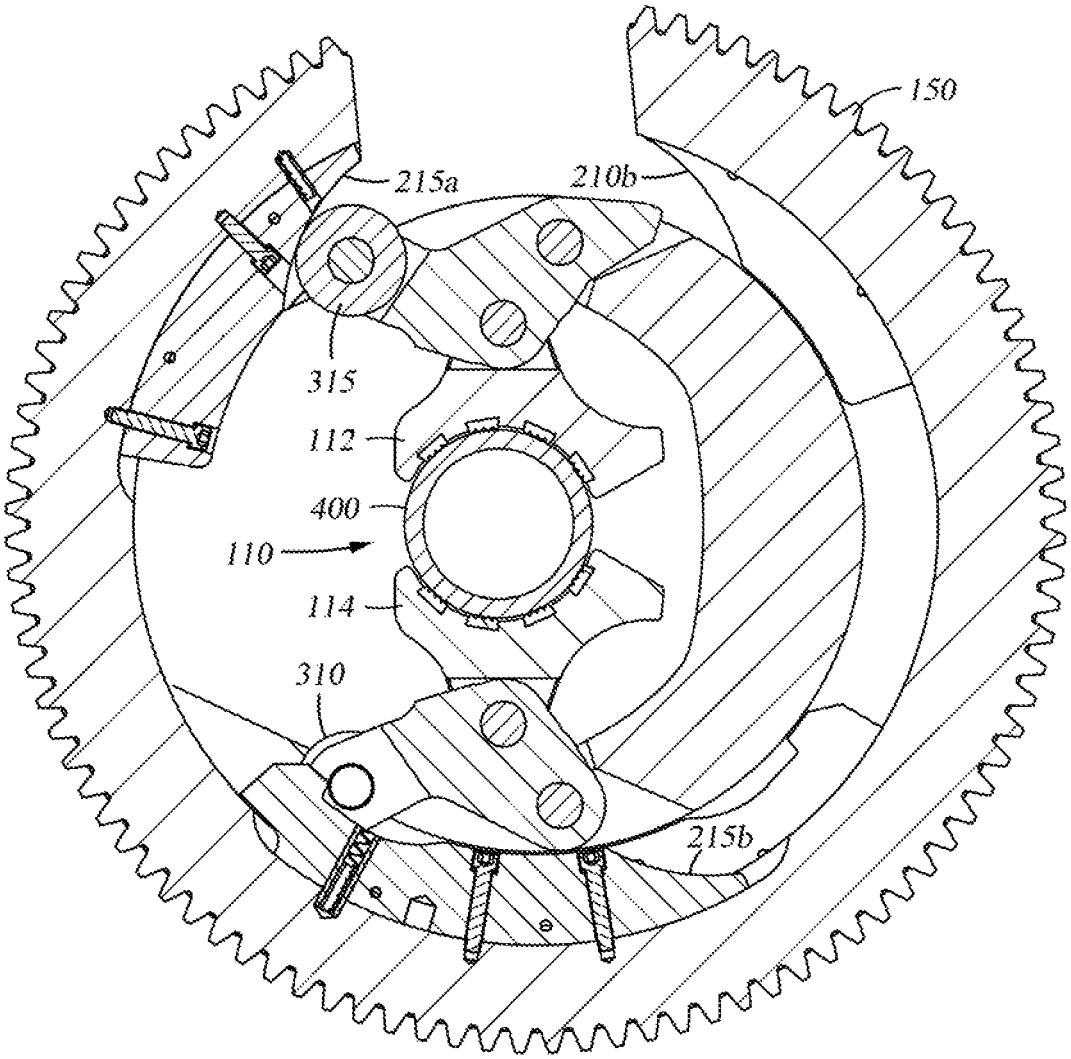
FIG. 9 is a top view partially in section, taken through the single wheel and showing the tubular member having been rotated in a clockwise direction to make a wellbore connection between tubulars.

FIG. 9 is a top view partially in section, taken through the single wheel 315 and showing the tubular member 400 having been rotated in a clockwise direction to make a wellbore connection between tubulars. Comparing FIGS. 8 and 9, in FIG. 9 the entire tong unit including gear ring 150 and brake plate 140 has been rotated as a unit. In this manner the tubular 400 retained by the upper portion of the tong 100 is rotated relative to a tubular gripped by a lower portion (not shown) in order to make a threaded connection. It will be appreciated the operation can be reversed, using the same wheels but operating on another set of ramps having reverse formations. In this manner, the tong assembly can be used to make or break a threaded connection between tubulars.

As described above, in order to actuate the gripping assembly 110, the brake plate 140 and gripping assembly must be rotationally fixed or at least rotationally limited relative to the gear ring while the gear ring 150 with its inwardly facing ramps rotates to a location whereby the ramps interact with the wheels of the gripping assembly to close the gripping members 112, 115 around a tubular 400. Thereafter, the gear wheel 150 and brake plate 140 rotate together to make or break a threaded connection. In one embodiment, rotation of the brake plate 140 is prevented with the use of a brake band 160 that is tightened around an outer surface of the plate in order to prevent its rotation. The brake band 160 and braking members 165*a, b* are shown in FIGS. 2 and 3. As shown, the band 160 extends around an outer perimeter of the plate 140 and is held at each end by one of the braking members. By holding the band at each end, the brake members can tighten the band 160 by urging each end towards the door 120 of the assembly, essentially removing slack in the band and thereby increasing its friction with the side of the brake plate 140. In one embodiment, the braking members each include a piston that urges a corresponding end of the brake band 160 in order to tighten it.

Figure 10:
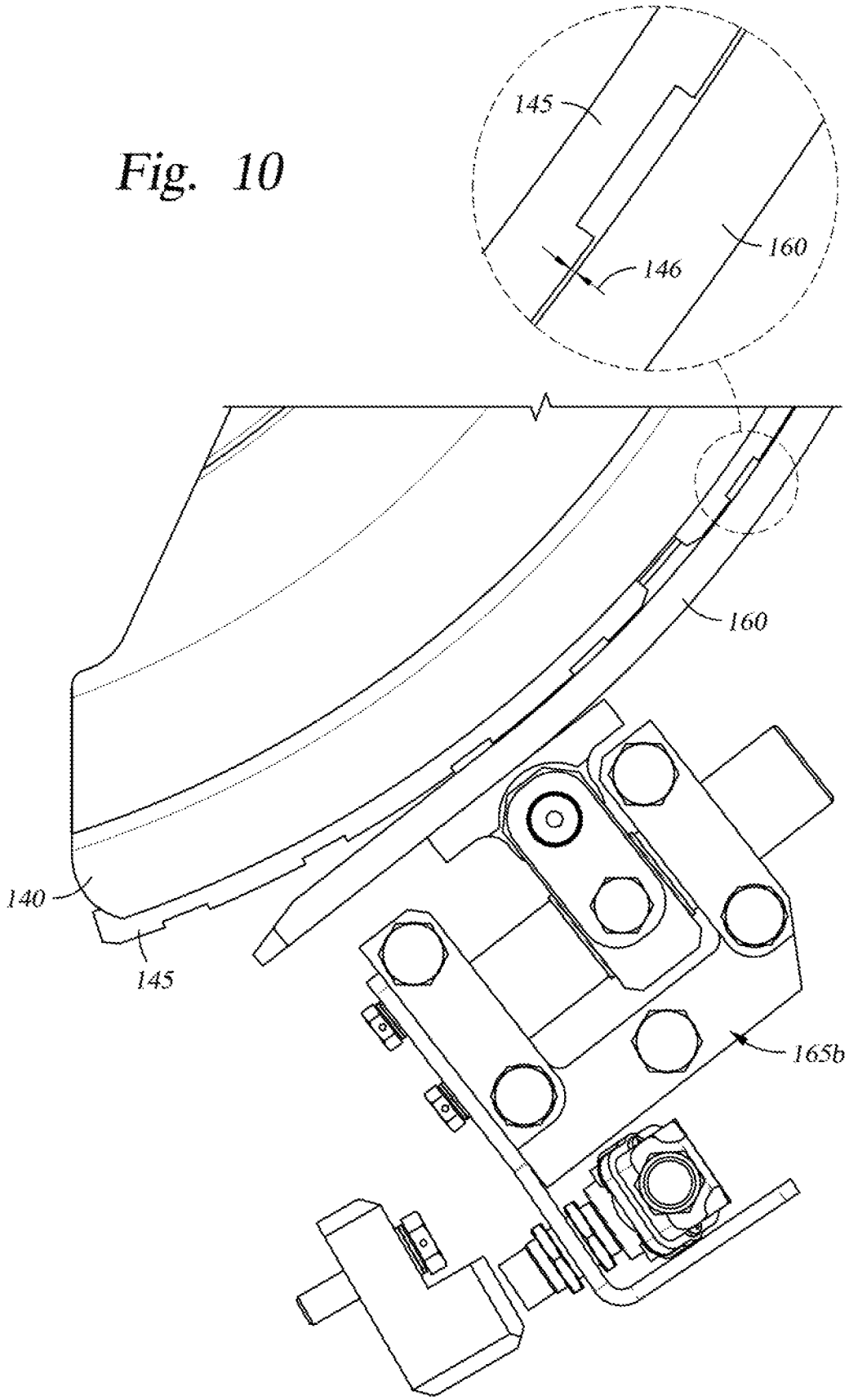
FIGS. 10 and 11 are top views of a braking member illustrating its operation in conjunction with a brake band to prevent rotation of the brake plate.
Figure 11:
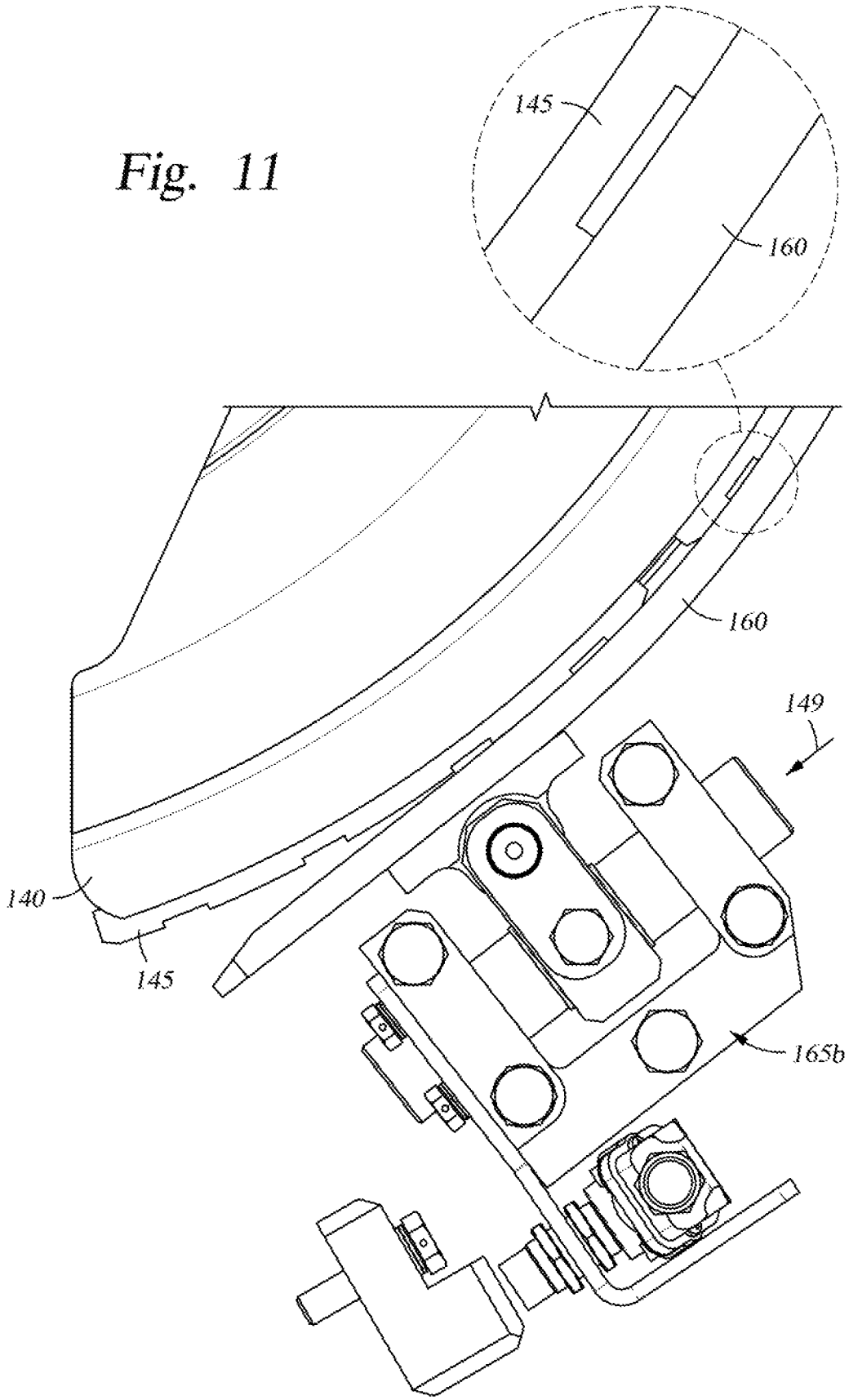

FIGS. 10 and 11 are top views showing the operation of one of the braking members 165*b* and its relationship with the brake plate 140. In FIG. 10 the brake is un-actuated as shown by a gap 146 formed between the band and an outer edge of a brake pad 145 disposed around an outer edge of the plate. FIG. 11 is a similar view however, in FIG. 11 the brake band has been tightened as apparent by the absence of gap 146 in the Figure. Arrow 149 illustrates the direction of a force placed upon the band in order to tighten it.

One novel aspect of the invention relates to brake pads and their location relative to the brake band and brake plate. In prior art devices, friction and heat generated between the tightened band and brake plate create wear and can cause failure of the entire tong assembly, essentially shutting down operations at a well site. In prior art devices, brake material including non-metallic, semi metallic and ceramic materials has been used on an inner surface of the brake band in order to effect braking between the band and brake plate. In order to extend the life of the brake band and to reduce friction and resulting heat between the surfaces, grease is applied at the intersection of the band and plate. The addition of grease reduces the heat and wear but must be replaced regularly requiring precious time at the working wellsite. Additionally, with or without grease, flexing of the band as it is tightened or loosened can cause the brake material to separate from the band. In one embodiment of the present invention, these problems and others are overcome by placing brake pads made of breaking and friction-reducing material not on the band but on the outer perimeter of the brake plate where it contacts the band.

Figure 12:
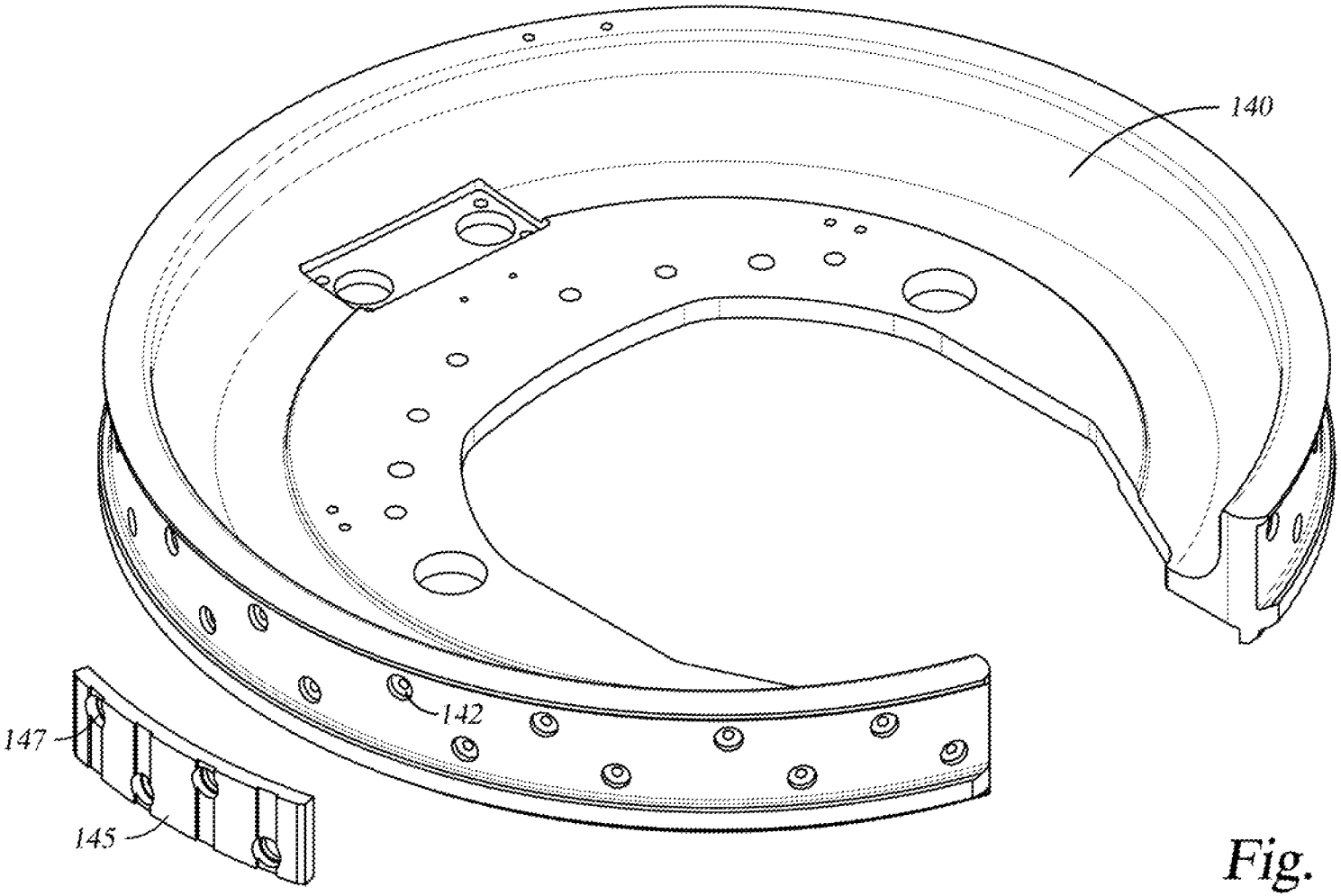
FIG. 12 is a perspective view of a brake plate illustrating the location of brake pads along an outer perimeter thereof.

FIG. 12 is a perspective view of the brake plate having apertures 142 around its perimeter for attachment of brake pads. One exemplary brake pad 145 is shown in the Figure. By fastening the brake pads with fasteners around the perimeter, a braking surface is provided in a manner whereby the material is protected from the flexing of the brake band. Additionally, the pieces can be replaced in any area where excessive wear has occurred without replacing the entire band or a large strip of the braking material. In one example, the brake pads are constructed primarily of bronze or sintered bronze. Bronze is an ahoy consisting primarily of copper, commonly with about 12% tin and often with the addition of other metals and sometimes non-metals or metalloids such as arsenic, phosphorus or silicon.

While the foregoing is directed to embodiments of the present disclosure, other and further embodiments of the disclosure may be devised without departing from the basic scope thereof, and the scope thereof is determined by the claims that follow.

The invention claimed is:

1. A tong for use at a wellbore, comprising:

a gear ring powered by a motor assembly, the gear ring having a plurality of ramps formed on an inner surface thereof;

a brake plate rotationally independent of the gear ring, the brake plate having a gripping assembly for interacting with the ramps to grip a tubular;

wherein in a first position of the gear ring relative to the brake plate, the gripping assembly is open and in a second position the assembly grips the tubular;

a brake assembly for preventing rotation of the brake plate, the brake assembly including an adjustable brake band for applying friction to the brake plate; and at least one brake pad affixed to an outer surface of the brake plate in the area of contact between the brake plate and the brake band.

2. The tong of claim 1, wherein the pads are substantially constructed of bronze.

3. The tong of claim 1, wherein the pads include a plurality of separate pads, each pad individually fastened to the brake plate.

4. A method of making a threaded connection between tubulars at a wellbore, the method comprising:

providing a tong assembly having a rotatable gear ring with ramps formed on an inner surface thereof;

providing a brake plate, the brake plate rotatably independent of the gear ring and having a gripping assembly associated therewith;

limiting rotation of the brake plate while rotating the gear ring, thereby causing the ramps of the gear ring to actuate the gripping assembly to grasp the tubular; and permitting rotation of the brake plate with the gear ring to make the connection between the tubulars; wherein rotation of the brake plate is limited by a brake band, the brake band creating friction between an inner surface thereof and braking material affixed to an adjacent perimeter of the brake plate.

5. The method of claim 4, wherein rotation of the brake plate is prevented by the brake band.

6. The method of claim 4, wherein the braking material includes brake pads made of bronze.

7. The method of claim 4, wherein limiting rotation of the brake plate comprises closing a gap between the brake band and the braking material.

8. A braking assembly for use with a wellbore tong, the assembly comprising:

a brake band constructed and arranged to apply friction to an outer perimeter of a brake plate to selectively prevent rotation thereof;

a first braking member disposed at a first end of the brake band, the braking member being piston-actuated for urging the first end towards a second end of the brake band, thereby increasing the friction between the band and the brake plate; and brake material affixed to the outer perimeter of the brake plate.

9. The assembly of claim 8, wherein the braking material is at least one brake pad.

10. The assembly of claim 9, wherein the at least one brake pad is constructed of bronze.

11. The assembly of claim 9, further including a second braking member disposed at the second end of the brake band.

12. The assembly of claim 9, further comprising a plurality of brake pads affixed to the outer perimeter of the brake plate.

13. The assembly of claim 12, wherein the plurality of brake pads are aligned circumferentially on the outer perimeter of the brake plate.

14. The assembly of claim 8, wherein the brake band is configured to apply friction to the outer perimeter of the brake plate by moving into contact with the brake material.

* * * * *